US009121214B2

(12) United States Patent
Sumiya

(10) Patent No.: US 9,121,214 B2
(45) Date of Patent: Sep. 1, 2015

(54) OPENING AND CLOSING MEMBER CONTROL APPARATUS AND METHOD FOR CONTROLLING OPENING AND CLOSING MEMBER

(71) Applicant: ASMO CO., LTD., Kosai, Shizuoka-pref. (JP)

(72) Inventor: Takahiro Sumiya, Chungcheongnam-do (KR)

(73) Assignee: ASMO CO., LTD., Shizuoka-pref. (JP)

( * ) Notice: Subject to any disclaimer, the term of this patent is extended or adjusted under 35 U.S.C. 154(b) by 0 days.

(21) Appl. No.: 14/022,456

(22) Filed: Sep. 10, 2013

(65) Prior Publication Data

US 2014/0083011 A1 Mar. 27, 2014

(30) Foreign Application Priority Data

Sep. 21, 2012 (JP) ..... 2012-208543

(51) Int. Cl.
*E05F 15/02* (2006.01)
*E05F 15/00* (2015.01)
*E05F 15/40* (2015.01)

(52) U.S. Cl.
CPC ..... *E05F 15/0004* (2013.01); *E05F 15/40* (2015.01); *E05Y 2900/50* (2013.01)

(58) Field of Classification Search
CPC ..... E05Y 2900/50; E05F 15/40; E05F 15/004
USPC ..... 49/26, 28, 348, 349, 350, 351, 502, 49/506; 318/264, 266, 267, 466, 480, 54, 318/467, 283, 434, 286
See application file for complete search history.

(56) References Cited

U.S. PATENT DOCUMENTS

| | | | | | |
|---|---|---|---|---|---|
| 4,733,145 | A * | 3/1988 | Ohashi et al. | 318/54 |
| 5,166,586 | A * | 11/1992 | Yaguchi | 318/434 |
| 5,537,013 | A * | 7/1996 | Toyozumi et al. | 318/283 |
| 5,616,997 | A * | 4/1997 | Jackson et al. | 318/467 |
| 5,955,854 | A * | 9/1999 | Zhang et al. | 318/480 |
| 6,366,040 | B1 * | 4/2002 | McLennan et al. | 318/280 |
| 7,843,153 | B2 * | 11/2010 | Held et al. | 318/264 |
| 2014/0173984 | A1 * | 6/2014 | Schlesiger et al. | 49/28 |

FOREIGN PATENT DOCUMENTS

| | | |
|---|---|---|
| JP | 2007-009573 A | 1/2007 |
| JP | 2011-122369 A | 6/2011 |

* cited by examiner

*Primary Examiner* — Jerry Redman
(74) *Attorney, Agent, or Firm* — Posz Law Group, PLC

(57) ABSTRACT

An open-close member control apparatus has a function to release a foreign matter pinched to an open-close member. The open-close member is either (i) driven only while a manipulation switch is manipulated or (ii) driven continuously once the manipulation switch is manipulated to a specified position regardless of whether the manipulation is then released. When trapping of a foreign matter is detected under an open movement of the open-close member to an open direction based on an open command signal from the manipulation switch, an electric power supply to a motor is restricted to stop a progress of the trapping. When receiving a close command signal from the manipulation switch after restricting the electric power supply, the electric power is supplied to the motor to drive the open-close member to a close direction under a restricted state of a predetermined operation.

8 Claims, 9 Drawing Sheets

OPENING AND CLOSING MEMBER CONTROL APPARATUS AND METHOD FOR CONTROLLING OPENING AND CLOSING MEMBER

CROSS REFERENCE TO RELATED APPLICATION

The present application is based on Japanese Patent Application No. 2012-208543 filed on Sep. 21, 2012, the disclosure of which is incorporated herein by reference.

TECHNICAL FIELD

The present disclosure relates to an open-close member control apparatus and a method for controlling an open-close member; in particular, the apparatus and the method are suitably applied in a vehicle to release a foreign matter, which is trapped between a window glass serving as the open-close member and a belt molding serving as a container of the open-close member in cases that the window glass is driven to an open direction or to descend.

BACKGROUND ART

Patent Literature 1: JP 2007-9573 A

Patent Literature 2: JP 2011-122369 A

There are conventionally known in-vehicle power window apparatuses which have a function to prevent a foreign matter being pinched when a widow glass is closed (or window glass ascends) (for example, refer to Patent Literature 1). Such a pinching prevention function of the power window apparatus detects a foreign matter, which is pinched when the window glass is driven to a close direction, and then drives a motor reversely to drive the window glass reversely.

In Patent Literature 1, in contrast, the power window apparatus does not have a function to prevent a foregoing matter that is trapped when the window glass is driven to an open direction. For instance, when the belt molding itself is trapped by the window glass, a load larger than usual is added to the motor. In this case, if the motor is operated continuously as it is, the motor may suffer a damage to produce unusual sound and lower the operating speed. In addition, if a foreign matter is trapped in between the belt molding and the window glass, the foreign matter may be damaged.

In contrast, when a trapping occurs in between the window glass and the belt molding, the window glass may be driven to ascend simply. However, in such a case, a usual pinching may occur in between the window glass and the upper portion of the window frame. To solve such a state, when a trapping is detected, the driving of the motor may be stopped or the motor may be operated to close the window glass (refer to Patent Literature 2).

While the technology in Patent Literature 2 may be effective in preventing trapping, another requirement or desire is presented which permits an occupant to release the trapping while confirming the situation. In addition, a system having a pinching prevention function but not a trapping prevention function may pose the following situation. That is, when a trapping of an arm arises, an occupant may operate the window glass to be closed or be moved up. Such a case may change a load to the trapped member to activate the pinching prevention function erroneously, thereby causing a reverse movement to open or lower the window glass and then causing a trapping again.

SUMMARY

It is an object of the present disclosure to provide an open-close member control apparatus and a method for controlling an open-close member. In the apparatus and the method, after a trapping of a foreign matter is detected during an open movement of a window glass serving as the open-close member and then drive of a motor is stopped, an occupant is permitted to release the trapping while confirming a situation of the trapping.

It is another object of the present disclosure to provide an open-close member control apparatus with a pinching prevention function and a method for controlling the same; the apparatus and the method prevent re-occurrence of trapping due to an erroneous operation of the pinching prevention function following an occurrence of trapping.

To achieve the above object, according to an aspect of the present disclosure, an open-close member control apparatus including an open-close member and having a function to release a foreign matter pinched to the open-close member is provided to include a driving motor a control circuit; a manipulation switch; an operating state detection section; a trapping detection section; and a pinching detection section. The driving motor drives the open-close member to an open direction or a close direction. The control circuit controls operation of the driving motor. The manipulation switch outputs an open command signal or a close command signal to the control circuit, the open command signal indicating driving of the open-close member to the open direction, the close command signal indicating driving of the open-close member to the close direction. The open-close member is either (i) driven only while the manipulation switch is manipulated or (ii) driven continuously once the manipulation switch is manipulated to a specified position regardless of whether the manipulation switch having been manipulated to the specified position is then released. The operating state detection section outputs an operating state detection signal according to an operating state of the open-close member that is driven to the open direction or the close direction by the driving motor. The trapping detection section performs a trapping detection to detect a trapping of a foreign matter to the open-close member based on the operating state detection signal. The pinching detection section performs a pinching detection to detect a pinching of a foreign matter to the open-close member based on the operating state detection signal. The control circuit is further configured to (i) restrict supplying an electric power to the driving motor to stop a progress of a trapping of a foreign matter to the open-close member when the trapping detection section detects the trapping under an open movement of the open-close member to the open direction, the open movement having been started based on the open command signal from the manipulation switch, and (ii) supply the electric power to the driving motor to drive the open-close member to the close direction under a restricted state when receiving the close command signal from the manipulation switch after restricting supplying the electric power, the restricted state restricting a predetermined operation.

According to another aspect of the present disclosure, a method is provided for controlling an open-close member in the open-close member control apparatus according to the above aspect, the apparatus having a function to release a foreign matter pinched to the open-close member. The method is executed by the control circuit of the apparatus and includes the following: (i) restricting supplying an electric power to the driving motor to stop a progress of a trapping of a foreign matter to the open-close member when the trapping detection section detects the trapping under an open movement of the open-close member to the open direction, the open movement having been started based on the open command signal from the manipulation switch; and (ii) supplying the electric power to the driving motor to drive the open-close member to the close direction under a restricted state when receiving the close command signal from the manipulation switch after restricting supplying the electric power, the restricted state restricting a predetermined operation.

Under the above apparatus or the method, when a trapping of a foreign matter to the open-close member is detected during the open movement started based on the open command signal from the manipulation switch, the electric power supply to the driving motor is restricted so as to stop the progress of the trapping to the open-close member. This permits stopping the progress of the trapping of the foreign matter during the open movement (descent) of a window glass serving as the open-close member. When thereafter receiving the close command signal from the manipulation switch, the electric power supply to the driving motor is started so as to drive the open-close member to the close direction under a restricted state of a predetermined operation. This permits an occupant to release the trapping while confirming the situation without depending on an automatic trapping release function. In addition, suitably specifying the restricted predetermined operation can avoid an erroneous operation of the pinching prevention function at the time of releasing the trapping. Furthermore, stopping the progress of the trapping simultaneously prevents (i) a damage of the foreign matter due to the progress of the trapping, and (ii) another anomaly in the apparatus such as unusual sound generation or movement speed decline.

BRIEF DESCRIPTION OF THE DRAWINGS

The above and other objects, features, and advantages of the present disclosure will become more apparent from the following detailed description made with reference to the accompanying drawings. In the drawings.

DETAILED DESCRIPTION

An embodiment according to the present disclosure will be explained with reference to drawings.

Figure 1:
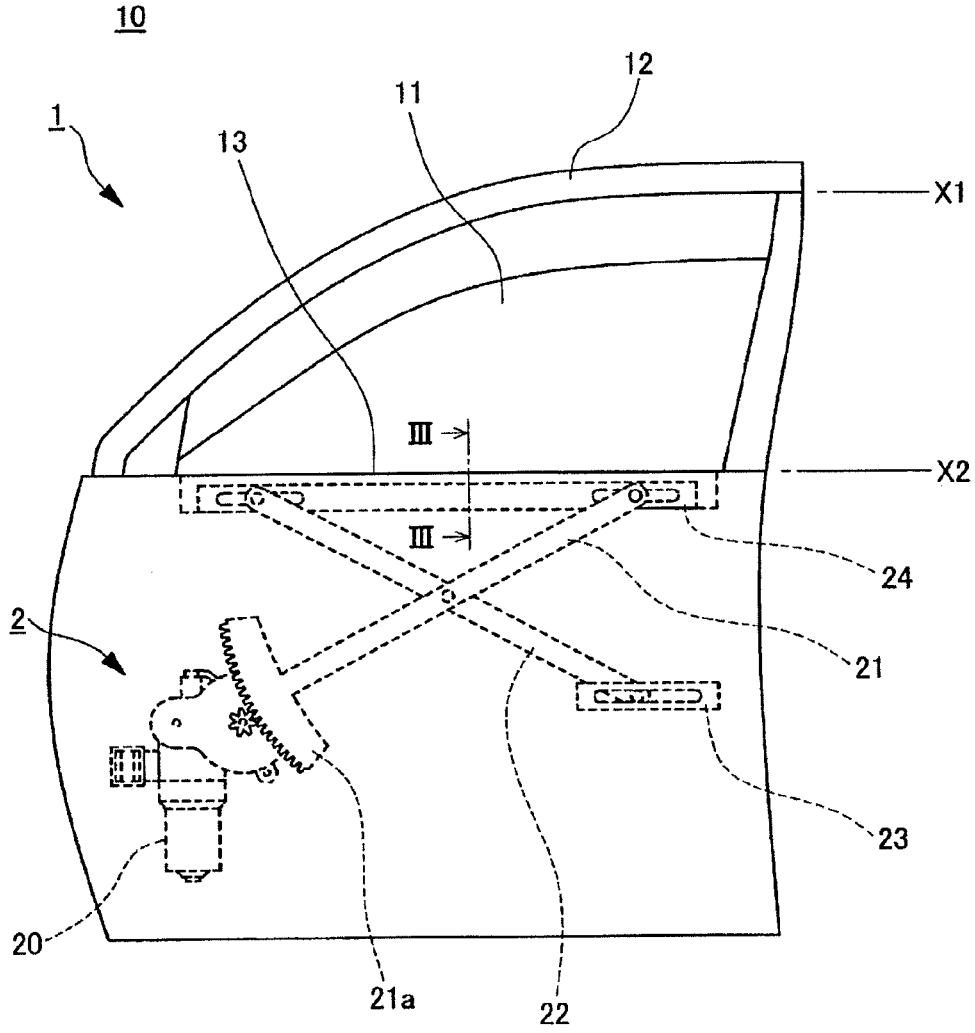
FIG. 1 is a diagram illustrating a configuration of an open-close member control apparatus according to an embodiment of the present disclosure.
Figure 2:
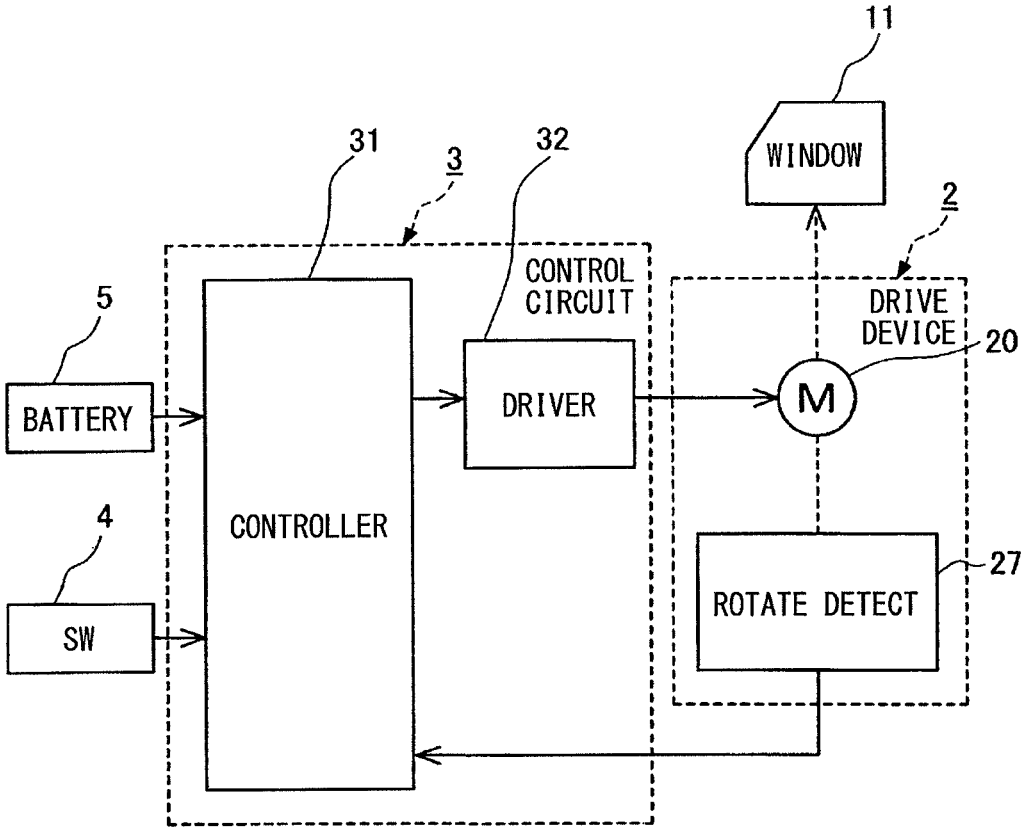
FIG. 2 is an electric block diagram of the open-close member control apparatus.
Figure 3:
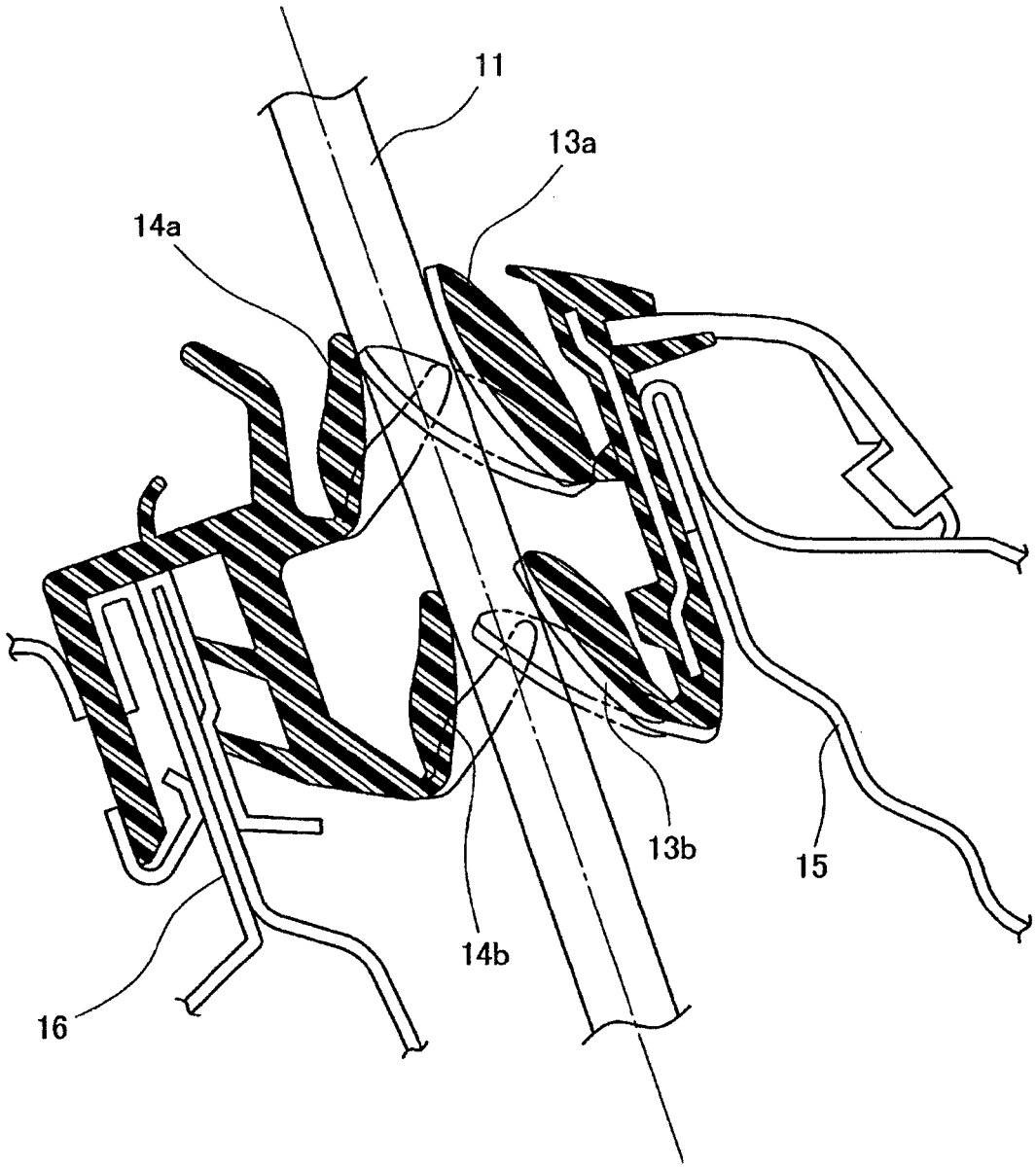
FIG. 3 is a cross-sectional diagram taken from line III-III in FIG. 1.

The following will explain a power window apparatus 1 as an open-close member control apparatus in a vehicle (also referred to as a host vehicle) according to an embodiment of the present disclosure. Refer to FIGS. 1, 2, and 3. The power window apparatus 1 includes a drive device 2 to drive opening and closing of an open-close member, a control circuit 3 to control the drive device 2, and a manipulation switch 4 for an occupant to input a command. That is, the apparatus 1 operates ascent and descent (open and close) of a window glass 11 serving as the open-close member disposed in a door 10 of the vehicle by rotation drive of a driving motor 20 included in the drive device 2.

The door 10 has an storage space (i.e., container) in a lower portion of the door 10 (i.e., under a beltline of the vehicle) to store the window glass 11 which is lowered; the storage space is provided between an outer panel 15 arranged on a vehicle exterior side (an outside of the vehicle in a width direction) and an inner panel 16 arranged on a vehicle interior side (an inside of the vehicle in the width direction). The door 10 has a window frame (glass frame) 12 in an upper portion; the window glass 11 is heightened or ascends beyond a lower frame portion of the window frame 12 to thereby appear from the storage space into an inside area of the window frame 12, thereby undergoing open-close or descent-ascent (up-down) movement.

The lower frame portion of the window frame 12 is provided with belt moldings 13 and 14 as a sealing member. The belt molding includes an outer molding 13 and an inner molding 14. The outer molding 13 is fixed to an upper portion of the outer panel 15; the inner molding 14 is fixed to an upper portion of the inner panel 16.

The window glass 11 passes or moves through a gap between the outer molding 13 and the inner molding 14, and undergoes an up-down movement (i.e., close movement and open movement) inside of the window frame 12. The outer molding 13 and the inner molding 14 include seal projections 13*a*, 13*b*, 14*a*, 14*b* projected to the window glass 11, respectively; these seal projections 13*a*, 13*b*, 14*a*, 14*b* are elastically press-fitted to glass surfaces of the window glass 11. Thus, the belt moldings 13, 14 may be also referred to as a storage portion or container.

In addition, the upper frame portion of the window frame 12 is similarly provided with a weather strip (i.e., upper molding) as a sealing member (unshown). The weather strip is provided with a groove that opens downwardly. The groove is formed to accommodate or receive an uppermost end of the window glass 11 by a predetermined length. The glass surface of the received uppermost end of the window glass 11 is press-fitted to the inner wall of the groove.

In the present embodiment, the window glass 11 undergoes an up-down movement of moving (i.e., ascending and descending) between a high fully-closed position X1 (uppermost end) and a low fully-opened position X2 (downmost end) according a predetermined rule. With reference to FIG. 1, the drive device 2 of the present embodiment includes the driving motor 20 (hereinafter, also referred to as a motor 20) and a driving mechanism. The motor 20 is fixed to the door 10 and has a deceleration mechanism. The driving mechanism includes an up-down arm 21 equipped with a fan-shaped or sector-shaped gear 21*a* driven by the motor 20; a driven arm 22 pivotally intersecting with the up-down arm 21; a fixed channel 23 fixed to the door 10; and a glass-side channel 24 integrated with the window glass 11.

The motor 20 receives an electric power supply from the control circuit 3; the winding of the rotator of the motor 20 receives electric current. This generates a magnetic attraction function between the rotator and a stator having a magnet, permitting forward and reverse rotation of the rotator. In the drive device 2 of the present embodiment, the rotation of the motor 20 swings the up-down arm 21 and the driven arm 22; the ends of the arms 21 and 22 slide under restriction by the channels 23 and 24 and are driven as an X link. This permits an up-down movement of the window glass 11.

The motor 20 is provided with a rotation detection unit 27; the rotation detection unit 27 is integrated into the motor 20 as one body. The rotation detection unit 27 outputs pulse signals (operating state detection signals), which is synchronized with rotation of the motor 20, to the control circuit 3. The rotation detection unit 27 is to detect a magnetic variation of the magnet rotated along with the output shaft of the motor 20 using a plurality of hall elements. Under such a configuration, the rotation detection unit 27 outputs the pulse signals in synchronization with the rotation of the motor 20. That is, the pulse signals are outputted for respective predetermined movement quantities of the window glass 11 or respective predetermined angles of rotation of the motor 20. Thereby, the rotation detection unit 27 can output the signals according to an operating state (i.e., movement) of the window glass 11, which are approximately proportional to the rotation speeds of the motor 20. Upon receiving the pulse signals from the rotation detection unit 27, the control circuit 3 counts pulse edges of the pulse signals, and detects the position of the window glass 11 from a pulse count value. In the present embodiment, the rotation detection unit 27 and the control circuit 3 may thus function as an operating state detection section, means or device.

In the present embodiment, the rotation detection unit 27 includes the hall elements; however, there is no need to be limited thereto. As long as the rotation of the motor 20 is detectable, an encoder may be adopted. In the present embodiment, the rotation detection unit 27 is provided in the motor 20 so as to detect the rotation of the output shaft of the motor 20 according to the movement of the window glass 11; however, there is no need to be limited thereto. The position of the window glass 11 may be directly detected by a well-known technology.

The control circuit 3 may be also referred to as a control device. The control circuit 3 of the present embodiment includes a controller 31 and a driver 32. The controller 31 and the driver 32 receive electric power necessary for operation from a battery 5 mounted in the vehicle. The controller 31 of the present embodiment includes a microcomputer provided with a CPU, an input circuit, an output circuit, and memories such as ROM and RAM. The CPU is electrically connected with the memories, the input circuit, and the output circuit via a bus. The controller 31 may include a DSP (Digital Signal Processor) or gate array.

The controller 31 controls the motor 20 to rotate forward or reverse via the driver 32 based on a command signal (e.g., a close drive signal or an open drive signal) from the manipulation switch 4, permitting the open-close movement of the window glass 11. In addition, the controller 31 detects the position of the window glass 11 based on the pulse signal received from the rotation detection unit 27, and adjusts the magnitude of the driving electric power provided to the motor 20 via the driver 32 depending on the detected position of the window glass 11. To be specific, the magnitude of the duty ratio is adjusted when controlling the magnitude of the driving electric power or voltage or controlling PWM (Pulse Width Modulation) in order to adjust the output of the motor 20.

The driver 32 includes an IC having FET (Field Electric Transistor), and switches the polarity of the electric power supply to the motor 20 based on an input signal from the controller 31. That is, when receiving a forward rotation command signal from the controller 31, the driver 32 provides electric power to the motor 20 so that the motor 20 rotates in the forward rotation direction. When receiving a reverse rotation command signal from the controller 31, the driver 32 provides electric power to the motor 20 so that the motor 20 rotates in the reverse rotation direction. In addition, when a rotation stop command signal is received from the controller 31, the electric power supply to the motor 20 is stopped. The driver 32 may switch the polarity using a relay circuit. In addition, the driver 32 may be incorporated or integrated into the controller 31. In this case, the controller 31 may function as the control circuit 3.

The controller 31 detects pulse edges that include rising portions and falling portions of pulse signals that are inputted, and calculates a rotation speed (rotational cycle) of the motor 20 based on intervals (cycles) of the pulse edges while detecting the direction of rotation of the motor 20 based on phase differences of the pulse signals. That is, the controller 31 calculates a movement speed of the window glass 11 indirectly based on the rotation speed (rotational cycle) of the motor 20, and specifies the moving direction of the window glass 11 based on the direction of rotation of the motor 20. In addition, the controller 31 counts the pulse edges. The pulse count value is subtracted or added in connection with the open-close movement of the window glass 11. The controller 31 specifies the opening and closing position of the window glass 11 based on the magnitude of the pulse count value.

That is, the window glass 11 can be driven on a basis of the fully close position X1 defined as a reference position. When the fully close position X1 is defined as a reference position, the fully close position X1 corresponds to a pulse count value of zero "0". Thereafter, in cases that the window glass 11 moves toward one end (e.g., fully open position X2) of a moving area (movement segment), the pulse count value is incremented each time receiving a pulse signal. In contrast, in cases that the window glass 11 moves toward the other end (e.g., fully close position X1) of the moving area, the pulse count value is decremented each time receiving a pulse signal. Further, the fully open position X2 may be designated as a reference position, instead, to drive the window glass 11. In this case, the fully open position X2 corresponds to a pulse count value of zero "0". When the window glass 11 moves toward the fully close position X1, the pulse count value is incremented. When the window glass 11 moves toward the fully open position X2, the pulse count value is decremented.

The manipulation switch 4 of the present embodiment includes, as a swing-type switch having two steps, an open switch, a close switch, or an auto switch; either switch is to operate an open-close member to open or close. When an occupant manipulates the manipulation switch 4, the command signal for an up-down operation of the window glass 11 is outputted to the controller 31. To be specific, when the manipulation switch 4 is manipulated to one end by one step, the open switch is turned on so as to output a usual open command signal to the controller 31; the usual open command signal is for controlling the window glass 11 to perform a usual open movement, which is an open movement executed only during being manipulated, to move to an open state or open direction. In contrast, when the manipulation switch 4 is manipulated to the other end by one step, the open switch is turned on so as to output a usual close command signal to the controller 31; the usual close command signal is for controlling the window glass 11 to perform a usual close movement, which is a close movement executed only during being manipulated, to move to a close state or close direction.

Further, when the manipulation switch 4 is manipulated to the one end by two steps, both the open switch and the auto switch are turned on so as to output an auto open command signal to the controller 31; the auto open command signal is for controlling the window glass 11 to perform an auto open movement, which is an open movement to move to a position just prior to the fully open position X2 even after the manipulation is stopped or released. Further, when the manipulation switch 4 is manipulated to the other end by two steps, both the close switch and the auto switch are turned on so as to output an auto close command signal to the controller 31; the auto close command signal is for controlling the window glass 11 to perform an auto close movement, which is a close movement to move to a position just prior to the fully close position X1 even after the manipulation is stopped or released.

While receiving the usual open command signal from the manipulation switch 4 (while the manipulation switch 4 is being manipulated), the controller 31 drives the motor 20 via the driver 32 to permit the usual open movement of the window glass 11. In contrast, while receiving the usual close command signal from the manipulation switch 4 (while the manipulation switch 4 is being manipulated), the controller 31 drives the motor 20 via the driver 32 to permit the usual close movement of the window glass 11. In addition, when receiving the automatic open command signal from the manipulation switch 4, the controller 31 drives the motor 20 via the driver 32 to permit the automatic open movement of the window glass 11 to the position just before the fully open position X2. In contrast, when receiving the automatic close command signal from the manipulation switch 4, the controller 31 drives the motor 20 via the driver 32 to permit the automatic close movement of the window glass 11 to the position just before the fully close position X1.

The controller 31 monitors whether a pinching by the window glass 11 occurs or not during the close movement of the window glass 11 (during the usual close movement or automatic close movement). That is, the occurrence of the pinching causes the decline of the moving speed (ascent speed) of the window glass 11 and the decline of the rotation speed of the motor 20 (the extension of the rotational cycle) that relates to the decline of the moving speed of the window glass 11. Therefore, the controller 31 monitors the variation of the rotation speed of the motor 20 continuously. In the present embodiment, the controller 31 detects the start of the pinching based on the variation of the rotation speed of the motor 20 (that is, the ascent speed of the window glass 11), and then determines the occurrence of the pinching (i.e., determines affirmatively the pinching) when detecting that the rotation speed varies by a predetermined quantity after detecting the start of the pinching.

Then, when determining affirmatively the pinching, the controller 31 performs a control with the pinching prevention function. That is, the controller 31 performs a pinching release control (open movement control) after determining the pinching; this release controls control the motor 20 to move reverse to release a foreign matter pinched by the window glass 11 to permit the window glass 11 to open by only a predetermined quantity. Further, when determining affirmatively the pinching, the controller 31 may stop the rotation of the motor 20 to stop the subsequent close movement of the window glass 11, to thereby permit the release of the foreign matter pinched by the window glass 11.

Further, the controller 31 is monitoring occurrence or non-occurrence of trapping by the window glass 11 when the window glass 11 performs open movement (usual open movement and automatic open movement). That is, the occurrence of the trapping causes the decline of the moving speed (descent speed) of the window glass 11 and the decline of the rotation speed of the motor 20 (the extension of the rotational cycle) that relates to the decline of the moving speed of the window glass 11. Therefore, the controller 31 monitors the variation of the rotation speed of the motor 20 continuously. The controller 31 detects the start of the trapping based on the variation of the rotation speed of the motor 20 (that is, the descent speed of the window glass 11), and then determines the occurrence of the trapping (i.e., determines affirmatively the trapping) when detecting that the rotation speed varies by a predetermined quantity after detecting the start of the trapping.

When determining affirmatively the trapping, the controller 31 performs a trapping progress stop process in order to release a foreign matter trapped in between the window glass 11 and the belt moldings 13 and 14; the trapping progress stop process is to control the supply of the electric power to the motor 20 to stop the movement of the motor 20 and the open movement (descent) of the window glass 11. Reversing simply the movement of the motor 20 to raise the window glass 11 upon determining the trapping may cause a pinching between the window glass 11 and the upper portion of the window frame 12. To that end, the occupant is permitted to release the trapping while confirming the situation. That is, the present embodiment operates as follows. While storing a state where a trapping progress stop process is activated upon determining a first occurrence of trapping, the controller 31 is provided to prevent re-occurrence (i.e., a second occurrence) of trapping during close movement after the first occurrence of trapping. Upon receiving a close movement command (i.e., close command signal) from the manipulation switch 4, the controller 31 performs the following controls singly or in a combined manner to prevent the re-occurrence of trapping.

(1) Canceling a pinching prevention function;

(2) Prohibiting an automatic close movement by the automatic switch;

(3) Prohibiting a pinching release function to operate an open movement after detecting a pinching;

(4) Restricting an operating time (i.e., movement time) for a close movement;

(5) Restricting an operating quantity (i.e., movement quantity or length) for a close movement.

As explained above, the controller 31 specifies the opening and closing position of the window glass 11 based on the magnitude of the pulse count value.

Figure 4A:
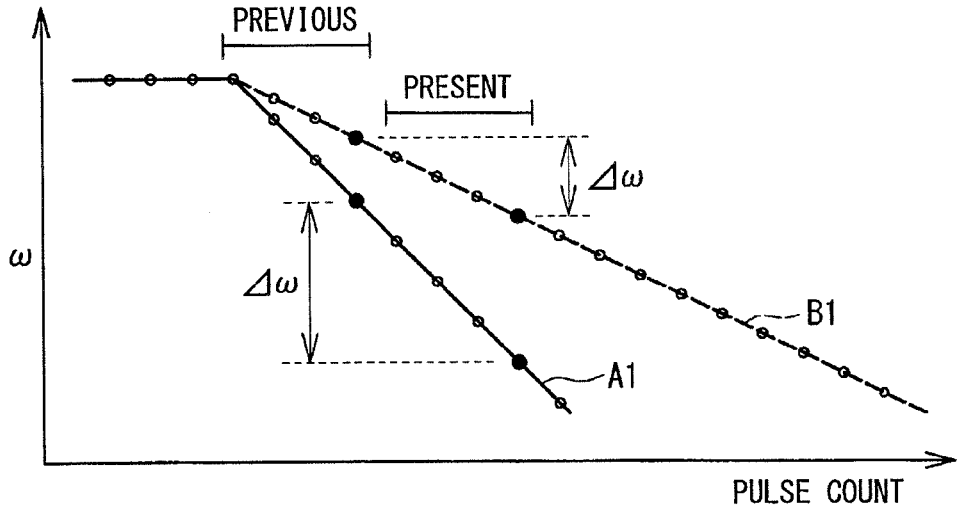
FIGS. 4A, 4B, 4C are diagrams for explaining trapping determination.
Figure 4B:
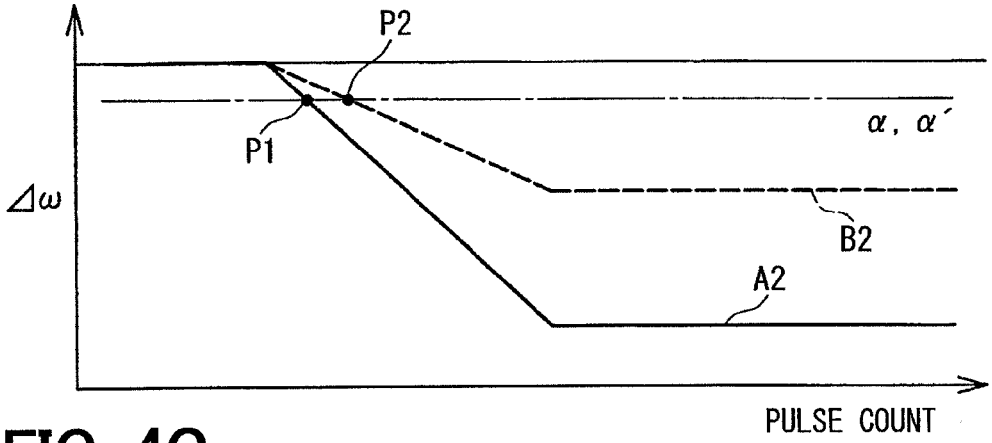
Figure 4C:
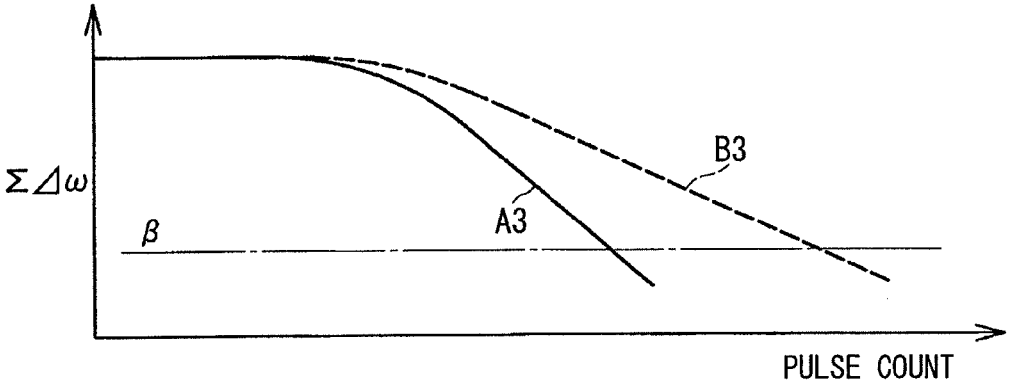

The following will explain an outline of a process to determine trapping in the apparatus 1 with reference to FIGS. 4A to 4C. The controller 31 calculates a rotation speed ω of the motor 20 based on pulse signals received from the rotation detection unit 27, and stores the calculated rotation speed ω of the motor 20. FIG. 4A illustrates a variation state of the rotation speed ω calculated in the above. The vertical axis of FIG. 4A corresponds to a motor rotation speed; the horizontal axis corresponds to a pulse count. FIG. 4A indicates an example of a state where the trapping decreases the rotation speed ω of the motor 20 from a middle time point. The data line A1 indicates a state where a hard matter is trapped to decrease the rotation speed ω with a large deceleration; the data line B1 indicates a state where a soft matter is trapped to decrease the rotation speed ω with a small deceleration. Further, in FIGS. 4B and 4C, the data lines A2 and A3 correspond to the state where a hard matter is trapped; the data lines B2, B3 correspond to a soft matter is trapped.

The apparatus 1 according to the present embodiment performs a moving speed variation computation using a CPU (unshown). A rotation speed difference Δω is calculated based on the data of the rotation speed ω; the rotation speed difference Δω is a difference between the rotation speed ω at the present time and the rotation speed ω at the time before the present time by several pulse edges. That is, the variation of the rotation speed ω at the present time against the rotation speed ω at the previous time is calculated. The rotation speed difference Δω is equivalent to the rate of change in the rotation speed (moving speed) or equivalent to the variation of the rotation speed from the time before the present time by the several pulse edges. FIG. 4B indicates the variation state of the rotation speed difference Δω. FIG. 4A indicates that the absolute value of the rotation speed difference Δω of the data line A1 is greater than that of the data line B1.

Now, the controller 31, which may function as a trapping detection section to detect a start of trapping, determines whether the calculated rotation speed difference Δω exceeds a variation determination threshold α. When determining exceeding of the variation determination threshold α, the controller 31 determines that a trapping starts. In FIG. 4B, the start of trapping is detected at the point P1 or the point P2. However, the trapping is not determined at this time, so the motor 20 continues rotating and the window glass 11 continues descent (open movement). The variation determination threshold α is designated in the apparatus 1 such that a soft matter (for example, a lip portion of the belt molding) is trapped to cause the resultant rotation speed difference Δω exceeds the variation determination threshold value α.

Thus, once the start of trapping is detected, the controller 31 determines whether the accumulated value of the rotation speed difference Δω (that is, the variation value of the rotation speed ω) since detecting the start of trapping exceeds a trapping determination threshold β. When the variation value of the rotation speed ω exceeds the trapping determination threshold β, the trapping is determined. FIG. 4C indicates a variation state of the accumulated value of the rotation speed difference Δω. The controller 31 determines the trapping (i.e., occurrence of trapping) when the accumulated value exceeds the trapping determination threshold β.

As explained above, the controller 31 determines the trapping when the accumulated value of the rotation speed difference Δω (that is, the variation value of the rotation speed ω) since detecting the start of trapping exceeds a trapping determination threshold β. Instead, the controller 31 may determine the trapping when the accumulated value of the rotation speed difference Δω for a predetermined period after detecting the start of trapping, or the accumulated value of the rotation speed difference Δω for a predetermined count (i.e., the rate of change in the rotation speed ω) exceeds the trapping determination threshold β.

As mentioned above, the apparatus 1 designates two thresholds. One variation determination threshold α is designated for the rotation speed difference Δω; the other trapping determination threshold β is designated for the variation of the rotation speed ω (i.e., total of rotation speed difference Δω). These two thresholds determine respective determination targets that are different from each other. In the present embodiment, the actual occurrence of the trapping is not determined by a duration or the number of pulse signals after the rotation speed difference Δω exceeds the variation determination threshold α. Trapping is determined based on the variation quantity of the rotation speed ω, which is calculated after the rotation speed difference Δω exceeds the variation determination threshold α.

Therefore, in the apparatus 1 of the present embodiment, when a foreign matter is trapped, the trapping load does not become greater. Trapping of a foreign matter may be determined while not providing a damage to the trapped foreign matter. In addition, even when a soft matter is trapped, the rotation speed difference Δω exceeds the variation determination threshold α in a comparatively early stage. When the variation value thereof thereafter exceeds the trapping determination threshold β, the trapping is determined. In this case, the trapped matter is a soft matter such as a lip portion of the belt molding; the rotation speed difference Δω does not become a small value (large as an absolute value). The accumulation of the rotation speed difference Δω starts once the variation determination threshold α is exceeded; thereby, when the accumulated value exceeds the trapping determination threshold β, the trapping can be determined certainly.

In addition, when a trapped matter is moderately hard, the apparatus 1 operates similarly to the case of the trapped matte being soft. That is, the accumulation of the rotation speed difference Δω starts once the variation determination threshold α is exceeded in a comparatively early stage; thereby, when the accumulated value exceeds the trapping determination threshold β, the trapping can be thus determined certainly. Thus, the apparatus 1 of the present embodiment can determine the trapping certainly under a small load, regardless of whether the trapped matter is soft or hard.

In addition, when the window glass 11 moves, the rotation speed of the motor 20 is influenced by sliding resistance or external factor even without occurrence of the trapping. Such influence may cause the rotation speed difference Δω to exceed the variation determination threshold α. Even in such a case, as long as the accumulated value of the rotation speed difference Δω does not exceed the trapping determination threshold β, the trapping is not determined. Even when the variation determination threshold α is set to a value for a soft matter being trapped, an erroneous determination is not made, and, rather, the start of trapping can be detected certainly.

In addition, the pinching determination by the power window apparatus 1 is operated similar to the trapping determination, and is thus omitted from the explanation. In a pinching determination, the controller 31, which may function as a pinching detection section to detect a start of pinching, determines whether the calculated rotation speed difference Δω exceeds a variation determination threshold α'. When the variation determination threshold α' is exceeded, the start of pinching is determined.

Figure 5:
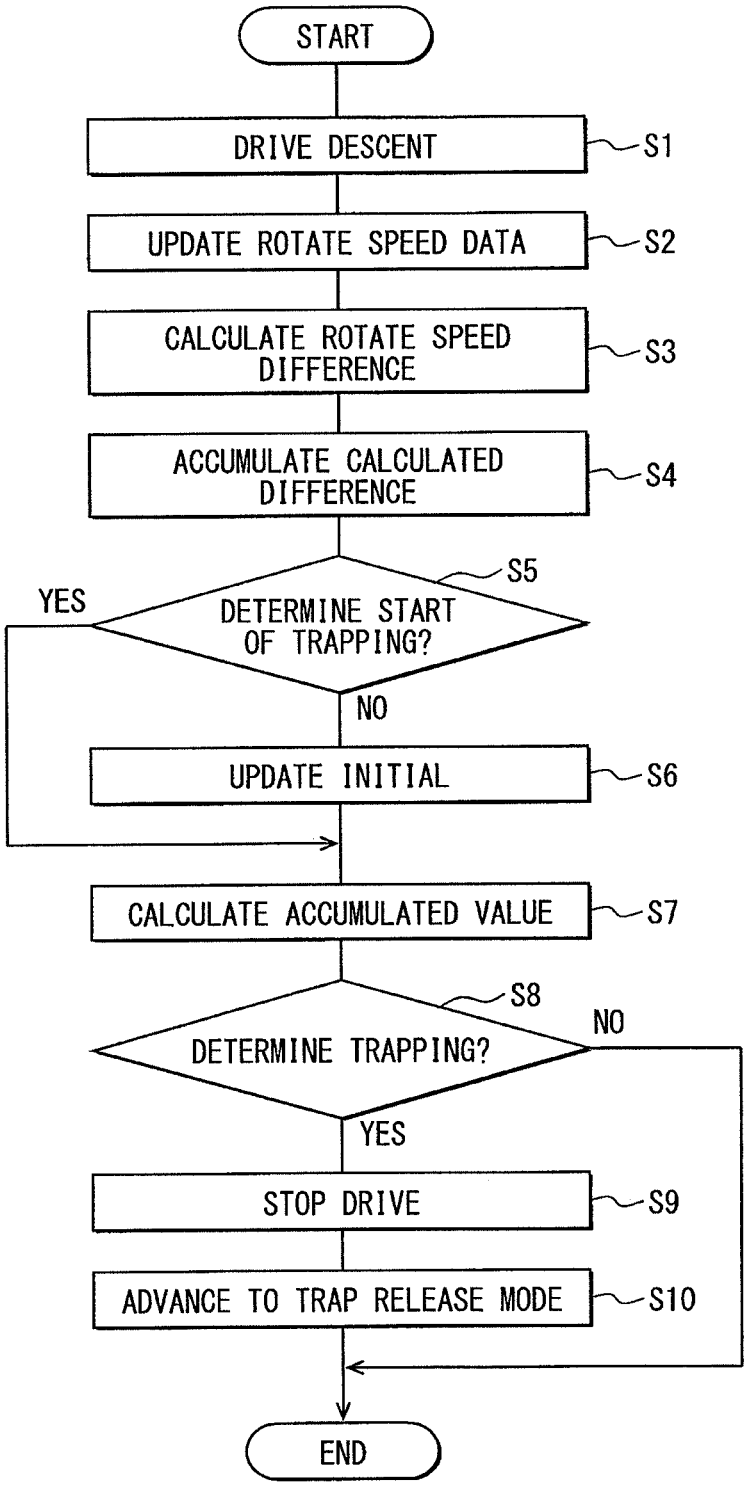
FIG. 5 is a flowchart diagram of a trapping determination process.

The following will explain a flowchart of a trapping determination process and a trapping release process by the control circuit 3 or controller 31 with reference to FIG. 5.

It is further noted that a flowchart in the present application includes sections (also referred to as steps), which are represented, for instance, as S1. Further, each section can be divided into several sections while several sections can be combined into a single section. Furthermore, each of thus configured sections can be referred to as a module, device, or means and achieved not only (i) as a software section in combination with a hardware unit (e.g., computer), but also (ii) as a hardware section (e.g., integrated circuit, hard-wired logic circuit), including or not including a function of a related apparatus. Further, the hardware section may be inside of a microcomputer.

First, when the controller 31 receives a usual open command signal or an automatic open command signal from the manipulation switch 4, the controller 31 drives the motor 20 via the driver 32 to drive descent movement of the window glass 11 (S1). Then, the controller 31 updates a rotation speed data of the motor 20 first based on the pulse signals received from the rotation detection unit 27 (S2). To be specific, the controller 31 processes a pulse signal received from the rotation detection unit 27, and detects a pulse edge. Each time detecting the pulse edge, a pulse width (time interval) T between (i) the pulse edge detected at the previous time and (ii) the pulse edge detected at the present time is calculated, and is stored one by one in a memory.

In the present embodiment, each time a new pulse edge is detected, the pulse width T is updated in order, and the newest four pulse widths T(0)-T(3) are stored. That is, when a pulse edge is detected, a new pulse width T(0) is calculated; the previous pulse widths T(0)-T(2) are shifted by one to be referred to as the pulse widths T(1)-T(3), respectively, and the previous pulse width T(3) is erased.

Then, the controller 31 calculates a rotation speed ω from the inverse number of the total (pulse cycle P) of the pulse widths T of n pulse edges serial in time. The rotation speed ω is a value proportional to the actual rotation speed. In the present embodiment, the (average) rotation speed ω(0) is calculated by the pulse widths T(0)-T(3) obtained from the present pulse edge and four previous pulse edges. Then, when the following pulse edge is detected, the rotation speed ω(0) is updated or replaced by the newly calculated pulse widths T(0)-T(3). At this time, the previous rotation speed ω(0) is stored as a rotation speed ω(1). Thus, the newest eight rotation speeds ω(0) to ω(7), which are updated each time a pulse edge is detected (with respect to each predetermined movement quantity or each predetermined rotation angle), are always stored in the controller 31. Thus, calculating the rotation speed ω using more than one pulse width T permits (i) offsetting of dispersion in a sensor duty of each received pulse signal output, and (ii) calculation of the rotation speed whose error variation is offset.

Next, the controller 31 calculates a (average) rotation speed difference Δω (i.e., rate of change of the rotation speed) from the rotation speed ω (S3). To be specific, the rotation speeds ω(0)×ω(3) are referred to as the present block data; the rotation speeds ω(4)-ω(7) are referred to as the previous block data. The sum of one block data is subtracted from the sum of the other block data. That is, the rotation speed difference Δω is calculated by subtracting the sum of the rotation speeds ω(0)-ω(3) from the sum of the rotation speeds ω(4)-ω(7), and updated each time a pulse edge is detected (every predetermined movement quantity or every predetermined rotation angle). The sum of the calculated values may be divided by the number of data for obtaining the sum (four in the present embodiment). Thus, calculating the rotation speed difference Δω using more than one rotation speed ω can offset the phase difference between the rotation speeds ω.

Then, the controller 31 adds the calculated rotation speed difference Δω on a basis of a predetermined position of the window glass 11 serving as a reference position (S4). Each time the rotation speed difference Δω is calculated, it is accumulated; thereby, the difference of the rotation speed ω with respect to the reference position is calculated. Next, the controller 31 performs a determination process of a trapping start (S5). To be specific, when the rotation speed difference Δω exceeds the variation determination threshold α to the negative side, the start of trapping is determined (or detected). When not exceeding, the start of trapping is not determined. When the start of trapping is determined (S5: Yes), the controller 31 advances to S7. When the start of trapping is not determined (S5: No), an initial value is set to each of the accumulated value of the rotational speed difference Δω and the trapping determination threshold β (S6). To be specific, the accumulated value of the rotation speed difference Δω calculated at S4 is set to a default variation amount So of the rotation speed ω, whereas the trapping determination threshold β is returned to a usual value that is not increased.

Then, the variation amount S of the rotation speed ω is calculated (S7). To be specific, the controller 31 subtracts the accumulated value of the rotation speed difference Δω calculated at S4 from the default variation amount So of the rotation speed ω set at S6 just before determining the start of trapping, thereby calculating the variation amount S of the rotation speed ω (accumulated value of the rotation speed difference Δω) after the start of trapping. This permits certainly the calculation of the variation portion of the rotation speed (i.e., trapping load) due to trapping.

In the present embodiment, the variation amount of the rotation speed ω after the start of trapping is calculated by calculating the difference of the variation amount from the reference value. There is no need to be limited thereto. When the start of trapping is not detected, the accumulated value of the rotational speed difference Δω may be initialized; when the start of trapping is detected, the accumulated value of the rotation speed difference Δω may not be initialized. This permits accumulation of the rotation speed difference Δω only after the start of trapping, thereby calculating the variation amount of the rotation speed ω.

Next, the controller 31 determines whether the variation amount S of the rotation speed ω calculated at S7 exceeds the trapping determination threshold β (S8). When it is determined that the variation amount S of the rotation speed ω exceeds the trapping determination threshold β (S8: Yes), the drive of the motor 20 is stopped to stop the descent drive (i.e., descent movement) of the window glass 11 (S9). Subsequently, the controller 31 advances to a trapping release mode (S10), and ends the present process. In contrast, when it is determined that the variation amount S of the rotation speed ω does not exceed the trapping determination threshold β (S8: No), the present process is ended without advancing further.

Figure 6:
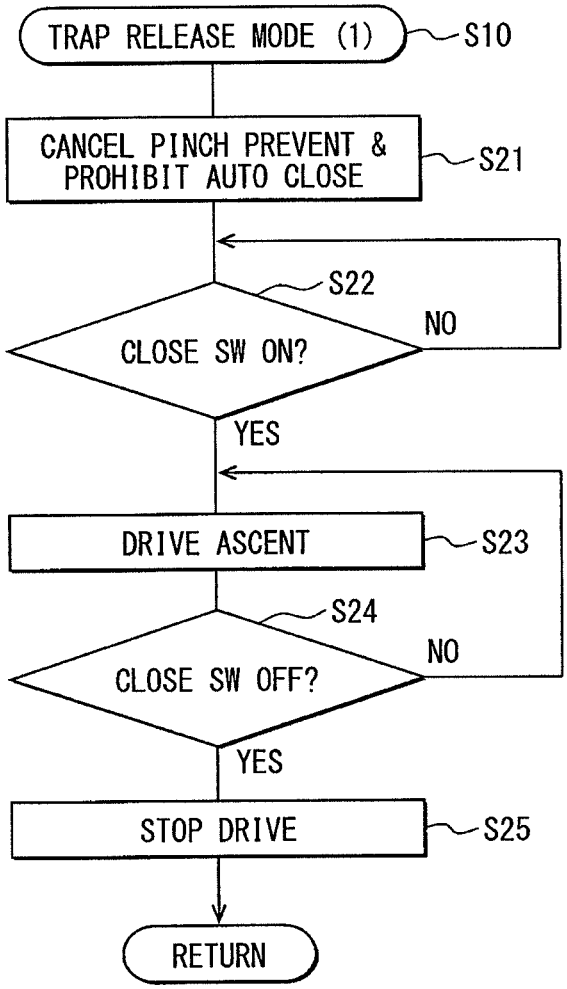
FIG. 6 is a flowchart diagram of a first example of a process of a trapping release mode.

The following will explain a first example of a process of a trapping release mode (S10) with reference to FIG. 6. The present process is executed when the drive of the motor 20 is stopped after the trapping or the occurrence of the trapping is determined at S8 of the trapping determination process in FIG. 5. The trapping release mode is to prevent re-occurrence of trapping due to an erroneous operation of the pinching prevention function. The controller 31 executes a prohibition control to prohibit the automatic close movement of the window glass 11 and a cancellation control to cancel the pinching prevention function, whereas releasing trapping by driving the window glass 11 reversely if receiving a close command signal from the manipulation switch 4.

First, the controller 31 prohibits the automatic close movement while canceling the pinching prevention function (S21). Here, S21 starts (i) clock counting of a predetermined time t1 and (ii) measuring of a predetermined distance L1, in order to restrict a duration during which the controller 31 continues (i) the cancelled state of the pinching prevention function and (ii) the prohibited state of the automatic close movement. The predetermined time t1 is previously designated in a timer (unshown); the predetermined distance L1 is previously designated to correspond to a pulse count value and is stored in a memory such as ROM. When S21 is executed, the controller 31 permits the timer to start clock counting while starting measuring of an ascent distance of the window glass 11 by incrementing or decrementing the pulse count value each time receiving a pulse signal.

Subsequently, it is determined whether the close switch of the manipulation switch 4 is turned on by determining whether a usual close command signal is received from the manipulation switch 4 (S22). When the close switch of the manipulation switch 4 is not turned on (S22: No), it is determined again whether the close switch of the manipulation switch 4 is turned on (S22). That is, S22 is repeated until receiving a usual close command signal from the manipulation switch 4.

When the close switch of the manipulation switch 4 is turned on (S22: Yes), the motor 20 is driven via the driver 32 to permit ascent movement of the window glass 11 (S23). The ascent movement of the window glass 11 enables the release of the trapping of the foreign matter. Subsequently, it is determined whether the close switch of the manipulation switch 4 is turned off by determining whether a usual close command signal from the manipulation switch 4 is stopped (S24). When the close switch of the manipulation switch 4 is not turned off (S24: No), it is determined that the manipulation switch 4 is still turned on; thereby, the motor 20 is ongoingly driven via the driver 32 to permit the ascent movement of the window glass 11 (S23). That is, S23 and S24 are repeated until detecting that the usual close command signal is stopped at S24. When the close switch of the manipulation switch 4 is turned off (S24: Yes), it is determined that the occupant can release the trapping of the foreign matter by the ascent movement of the window glass 11. Thereby, the drive of the motor 20 is stopped via the driver 32 to stop the ascent movement of the window glass 11 (S25); then, the controller 31 returns to the trapping determination process in FIG. 5. In addition, it may be determined that the predetermined time t1 elapses since executing S21 or that the ascent distance of the window glass 11 reaches the predetermined distance L1 due to the clock counting or the measuring of the ascent distance, which is started at S21. In such a case, the controller 31 releases the cancelled state of the pinching prevention function and the prohibited state of the automatic close movement of the window glass 11.

Figure 7:
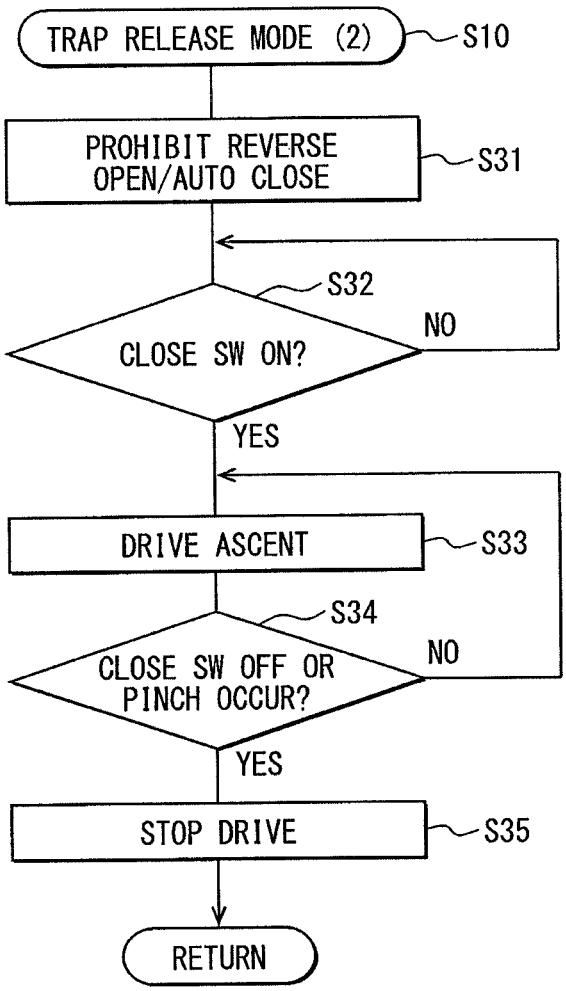
FIG. 7 is a flowchart diagram of a second example of a process of a trapping release mode.

At the process of the trapping release mode (S10), the controller 31 may execute a second example of the process in FIG. 7, instead of the process in FIG. 6. The present process in FIG. 7 is executed when the drive of the motor 20 is stopped after the trapping or the occurrence of the trapping is determined at S8 of the trapping determination process in FIG. 5. Similarly, the trapping release mode is to prevent re-occurrence of trapping due to an erroneous operation of the pinching prevention function. The controller 31 executes a prohibition control to prohibit the automatic close movement of the window glass 11 and a prohibition control to prohibit a pinching release operation (i.e., open movement) following detection of a pinching, whereas releasing trapping by driving the window glass 11 reversely if receiving an open command signal from the manipulation switch 4.

First, the controller 31 prohibits the automatic close movement while prohibiting the pinching release operation (open movement) after detecting the pinching (S31). Here, S31 starts clock counting of a predetermined time t2 and measuring of a predetermined distance L2 in order to restrict a duration during which the controller 31 continues the prohibited state of (i) the automatic close movement and (ii) pinching release operation (open movement) after detecting the pinching. The predetermined time t2 is previously designated in a timer (unshown); the predetermined distance L2 is previously designated to correspond to a pulse count value and is stored in a memory such as ROM. When S31 is executed, the controller 31 permits the timer to start clock counting while starting measuring an ascent distance of the window glass 11 by incrementing or decrementing the pulse count value each time receiving a pulse signal. Subsequently, it is determined whether the close switch of the manipulation switch 4 is turned on by determining whether a usual close command signal is received from the manipulation switch 4 (S32). When the close switch of the manipulation switch 4 is not turned on (S32: No), it is determined again whether the close switch of the manipulation switch 4 is turned on (S32). That is, S32 is repeated until receiving a usual close command signal from the manipulation switch 4.

When the close switch of the manipulation switch 4 is turned on (S32: Yes), the motor 20 is driven via the driver 32 to permit ascent movement of the window glass 11 (S33). The ascent movement of the window glass 11 enables the release of the trapping of the foreign matter. Subsequently, it is determined whether a pinching occurs and whether the close switch of the manipulation switch 4 is turned off (S34). Here, when the rotation speed difference $\Delta\omega$ exceeds the variation determination threshold $\alpha 7$ to the negative side, the start of pinching is determined. When not exceeding, the start of pinching is not determined.

When no pinching occurs and the close switch of the manipulation switch 4 is not turned off (S34: No), the motor 20 is ongoingly driven via the driver 32 to permit the ascent movement of the window glass 11 (S33). That is, S33 and S34 are repeated until detecting that the pinching arises or that the usual close command signal is stopped at S34. When the pinching occurs or the close switch of the manipulation switch 4 is turned off (S34: Yes), the controller 31 determines as follows. The occurrence of the pinching may cause another foreign matter to be pinched in between the window glass 11 and the window frame 12 to pose a secondary incident or anomaly if the close movement is continued; otherwise, the occupant released the pinching of a foreign matter by the ascent of the window glass 11. Thereby, the drive of the motor 20 is stopped via the driver 32 to stop the ascent movement of the window glass 11 (S35); then, the controller 31 returns to the trapping determination process in FIG. 5. In addition, it may be determined that the predetermined time t2 elapses since executing S31 or the ascent distance of the window glass 11 reaches the predetermined distance L2 due to the clock counting or the measuring of the ascent distance, which is started at S31. In such a case, the controller 31 releases the prohibited state of the automatic close movement and the prohibited state of the pinching release operation (open movement) after detecting the pinching.

Figure 8:
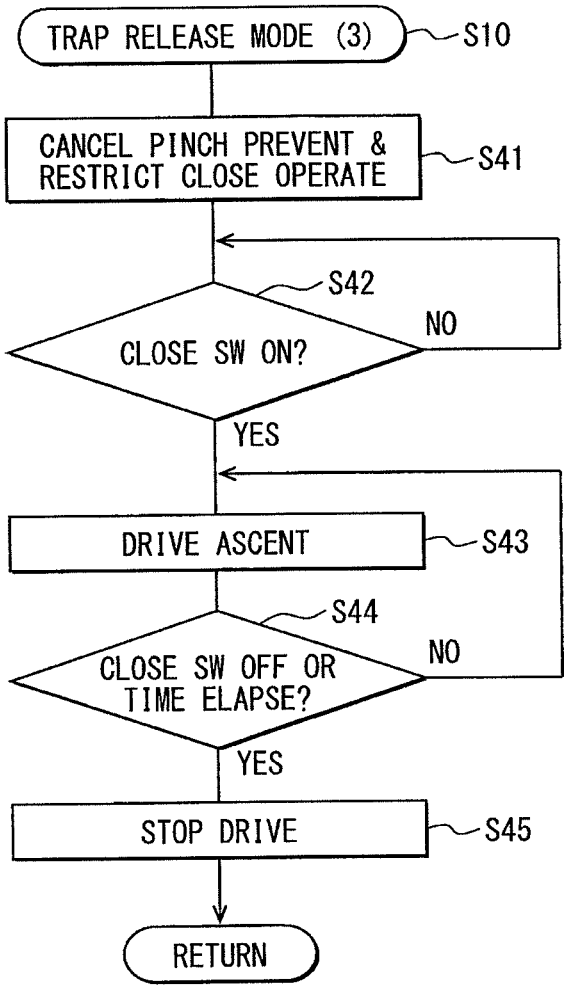
FIG. 8 is a flowchart diagram of a third example of a process of a trapping release mode.

At the process of the trapping release mode (S10), the controller 31 may execute a third example of the process in FIG. 8, instead of the process in FIG. 6. The present process in FIG. 8 is executed when the drive of the motor 20 is stopped after the trapping or the occurrence of the trapping is determined at S8 of the trapping determination process in FIG. 5. Similarly, the trapping release mode in FIG. 8 is to prevent re-occurrence of trapping due to an erroneous operation of the pinching prevention function. The controller 31 executes a restriction control to restrict a movement quantity of the close movement of the window glass 11 and a cancellation control to cancel the pinching prevention function, whereas releasing trapping by driving the window glass 11 reversely if receiving a close command signal from the manipulation switch 4.

First, the controller 31 executes a restriction process to restrict a movement quantity of the close movement (i.e., close movement quantity) while canceling the pinching prevention function (S41). The restriction process of the close movement quantity designates a predetermined time t to a timer (unshown); the predetermined time t corresponds to the close movement quantity by the reverse drive of the motor 20 at the time of detecting a trapping. The designated time t is stored in a memory such as ROM. Here, S41 starts clock counting of a predetermined time t3 and measuring of a predetermined distance L3 in order to restrict a duration during which the controller 31 continues the cancelled state of the pinching prevention function and the restricted state of the close movement quantity. The predetermined time t3 is previously designated in a timer (unshown); the predetermined distance L3 is previously designated to correspond to a pulse count value and is stored in a memory such as ROM. When S41 is executed, the controller 31 permits the timer to start clock counting while starting to measure an ascent distance of the window glass 11 by incrementing or decrementing the pulse count value each time receiving a pulse signal. Subsequently, it is determined whether the close switch of the manipulation switch 4 is turned on by determining whether a usual close command signal is received from the manipulation switch 4 (S42). When the close switch of the manipulation switch 4 is not turned on (S42: No), it is determined again whether the close switch of the manipulation switch 4 is turned on (S42). That is, S42 is repeated until receiving a usual close command signal from the manipulation switch 4.

When the close switch of the manipulation switch 4 is turned on (S42: Yes), the controller 31 starts clock counting of the timer and then drives the motor 20 via the driver 32 to permit ascent movement of the window glass 11 (S43). The ascent movement of the window glass 11 enables the release of the trapping of the foreign matter. Subsequently, it is determined whether the close switch of the manipulation switch 4 is turned off or whether the predetermined time t elapses based on the counted value of the timer (S44).

When the close switch of the manipulation switch 4 is not turned off and the predetermined time t does not elapse (S44: No), it is determined that the manipulation switch 4 is still turned on; thereby, the motor 20 is ongoingly driven via the driver 32 to permit the ascent movement of the window glass 11 (S43). That is, S43 and S44 are repeated until detecting that the close switch is turned off or that the predetermined time t elapses at S44. When the close switch of the manipulation switch 4 is turned off or the predetermined time t elapses (S44: Yes), the controller 31 determines that the occupant released the trapping of the foreign matter by the ascent of the window glass 11 or that the window glass 11 ascends for a time period sufficient to release the trapping of the foreign matter. Thereby, the drive of the motor 20 is stopped via the driver 32 to stop the ascent movement of the window glass 11 (S45); then, the controller 31 returns to the trapping determination process in FIG. 5. In addition, it may be detected that the predetermined time t3 elapses since executing S41 or the ascent distance of the window glass 11 reaches the predetermined distance L3 due to the clock counting or the measuring of the ascent distance, which is started at S41. In such a case, the controller 31 releases the cancelled state of the pinching prevention function and the restricted state of the close movement quantity.

Figure 9:
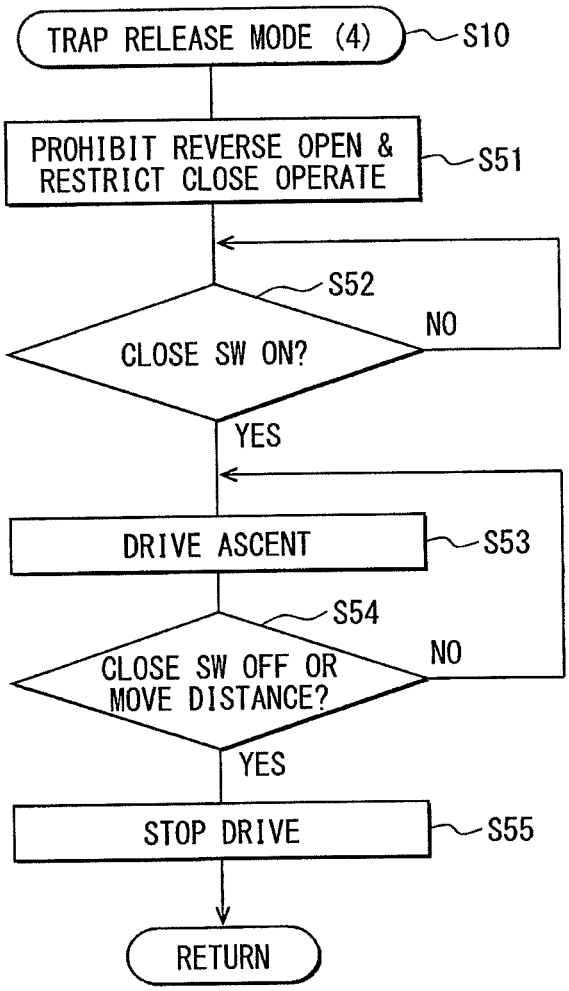
FIG. 9 is a flowchart diagram of a fourth example of a process of a trapping release mode.

At the process of the trapping release mode (S10), the controller 31 may execute a fourth example of the process in FIG. 9, instead of the process in FIG. 6. The present process in FIG. 9 is executed when the drive of the motor 20 is stopped after the trapping or the occurrence of the trapping is determined at S8 of the trapping determination process in FIG. 5. Similarly, the trapping release mode is to prevent re-occurrence of trapping due to an erroneous operation of the pinching prevention function. The controller 31 executes a restriction control to restrict a movement quantity of the close movement (i.e., close movement quantity) of the window glass 11 and a prohibition control to prohibit the pinching release operation (open movement) after detecting a pinching while releasing trapping by moving the window glass 11 reversely upon receiving a close command signal from the manipulation switch 4.

First, the controller 31 prohibits the restriction process of the close movement quantity while prohibiting the pinching release operation (open movement) after detecting the pinching (S51). The restriction process of the close movement quantity designates a predetermined distance L that corresponds to a pulse count value as the close movement quantity by the reverse drive of the motor 20 at the time of detecting a trapping. The designated value is previously stored in a memory such as ROM. Here, S51 starts clock counting of a predetermined time t4 and measuring of a predetermined distance L4 in order to restrict a duration during which the controller 31 continues the restricted state of the close movement quantity and the prohibited state of the pinching release operation (open movement) after detecting the pinching. The predetermined time t4 is previously designated in a timer (unshown); the predetermined distance L4 is previously designated to correspond to a pulse count value and is stored in a memory such as ROM. When S51 is executed, the controller 31 permits the timer to start clock counting while starting to measure an ascent distance of the window glass 11 by incrementing or decrementing the pulse count value each time receiving a pulse signal. Subsequently, it is determined whether the close switch of the manipulation switch 4 is turned on by determining whether a usual close command signal is received from the manipulation switch 4 (S52). When the close switch of the manipulation switch 4 is not turned on (S52: No), it is determined again whether the close switch of the manipulation switch 4 is turned on (S52). That is, S52 is repeated until receiving a usual close command signal from the manipulation switch 4.

When the close switch of the manipulation switch 4 is turned on (S52: Yes), the motor 20 is driven via the driver 32 to permit ascent movement of the window glass 11 (S53). Under the ascent movement, each time receiving a pulse signal, the pulse count value is incremented or decremented, the ascent distance of the window glass 11 is measured. The ascent movement of the window glass 11 enables the release of the trapping of the foreign matter. Subsequently, it is determined whether a pinching occurs and whether the predetermined distance L is exceeded (S54). Here, when the rotation speed difference $\Delta\omega$ exceeds the variation determination threshold $\alpha$7 to the negative side, the start of pinching is determined. When not exceeding, the start of pinching is not determined. In addition, when the incremented or decremented pulse count value during the ascent movement of the window glass 11 reaches the predetermined distance L, it is determined that the window glass 11 ascends by the predetermined distance L.

When no pinching occurs and the window glass 11 does not ascend by the predetermined distance L (S54: No), the motor 20 is ongoingly driven via the driver 32 to permit the ascent movement of the window glass 11 (S53). That is, S53 and S54 are repeated until detecting the occurrence of the pinching or the ascent of the predetermined distance L at S54. When a pinching occurs or the window glass 11 ascends by the predetermined distance L (S54: Yes), the controller determines as follows. The occurrence of the pinching may cause another foreign matter to be pinched in between the window glass 11 and the window frame 12 to pose a secondary incident or anomaly if the close movement is continued; otherwise, the window glass 11 ascends by a distance sufficient to release the trapping of the foreign matter. Thereby, the drive of the motor 20 is stopped via the driver 32 to stop the ascent movement of the window glass 11 (S55); then, the controller 31 returns to the trapping determination process in FIG. 5. In addition, it may be determined that the predetermined time t4 elapses since executing S51 or the ascent distance of the window glass 11 reaches the predetermined distance L4 due to the clock counting or the measuring of the ascent distance, which is started at S51. The controller 31 releases the restricted state of the close movement quantity and the prohibited state of the pinching release operation (open movement) after detecting the pinching.

In the above embodiment, the variation determination threshold $\alpha$ and the trapping determination threshold $\beta$ are maintained as the same values regardless of the position of the window glass 11. There is no need to be limited thereto. Those thresholds may be changed depending on the position of the window glass 11. Further, in the above embodiment, the trapping and the pinching are detected by the change of the rotation speed ω of the motor 20 calculated based on the pulse signal (operating state detection signal) received from the rotation detection unit 27. Alternatively, such an operating state whether the window glass 11 contacts a foreign matter may be detectable based on the current value which flows into the winding of the motor 20 as well as based on the change of the velocity of the window glass 11 or the change of the rotation speed co of the motor 20. For example, the occurrence of a pinching gives a load to the motor 20, increases the electric current to the motor 20, and decreases the voltage to the motor 20. The controller 31 may investigate whether a variation of the electric current exceeds a threshold value, and investigate, when exceeding, whether the variation of the electric power exceeds a threshold value; thereby, the pinching can be detected. In this case, the current value or voltage value, which is outputted to the controller 31, may correspond to an operating state detection signal. In addition, the above embodiment explains the open-close member control apparatus as the vehicular power window apparatus 1. There is no need to be limited thereto. The open-close member control apparatus may be applied to another apparatus to drive an open-close movement of an open-close member such as a sunroof open-close apparatus or a slide door open-close apparatus.

While aspects of the disclosure described herein are already recited in the preceding summary, further optional aspects thereto may be set out as follows.

According to an optional aspect of the present disclosure, the restricted predetermined operation may include a pinching prevention operation which controls the open-close member to be driven reversely by operating the driving motor reversely when the pinching detection section detects a pinching of a foreign matter to the open-close member.

At the time of releasing the trapping, the pinching prevention function may malfunction because of the load change by the foreign matter having been trapped. The above configuration helps prevent the foreign matter having been trapped from being trapped again when the pinching prevention function malfunctions.

According to an optional aspect, the restricted predetermined operation may include a continuous drive operation of the open-close member to the close direction.

This configuration prevents the open-close member from continuing a close movement automatically irrespective of the situation of the trapping. This permits an occupant to control the release of the trapping using a close movement while confirming the situation of the trapping.

According to an optional aspect, the restricted predetermined operation may include a pinching release operation to drive the open-close member, which has been driven to the close direction, to the open direction.

At the time of releasing the trapping, a pinching may be erroneously determined because of the load change by the foreign matter having been trapped. The above configuration helps prevent the foreign matter having been trapped from being trapped again when a pinching release operation is activated following determining the pinching erroneously.

According to an optional aspect, the restricted predetermined operation may include a drive operation of the open-close member to the close direction for a time exceeding a predetermined operating time.

This configuration prevents the open-close member from continuing a close movement automatically irrespective of the situation of the trapping. This permits an occupant to control the release of the trapping using a close movement while confirming the situation of the trapping.

According to an optional aspect, the restricted predetermined operation may include a drive operation of the open-close member to the close direction by a distance exceeding a predetermined movement distance.

This configuration prevents the open-close member from continuing a close movement automatically irrespective of the situation of the trapping. This permits an occupant to control the release of the trapping using a close movement while confirming the situation of the trapping.

According to an optional aspect, the predetermined operation may be restricted until a predetermined time elapses or until the open-close member moves by a predetermined distance.

Under the above configuration, the pinching preventing function is recovered after the predetermined time elapses or the open-close member moves by the predetermined distance. This permits the detection of a pinching newly occurring after releasing the trapping.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An opening and closing member control apparatus including an opening and closing member that moves in an open or close direction to at least partially open or close, respectively, an area within a window frame of the opening and closing member control apparatus, the opening and closing member control apparatus comprising:

a driving motor which drives the opening and closing member in the open direction or the close direction;

a control circuit which controls operation of the driving motor;

a manipulation switch which outputs an open command signal or a close command signal to the control circuit, the open command signal indicating driving of the opening and closing member in the open direction, the close command signal indicating driving of the opening and closing member in the close direction, the opening and closing member being either (i) driven only while the manipulation switch is manipulated or (ii) driven continuously once the manipulation switch is manipulated to a specified position regardless of whether the manipulation switch having been manipulated to the specified position is then released;

an operating state detection section which outputs an operating state detection signal according to an operating state of the opening and closing member that is driven in the open direction or in the close direction by the driving motor;

a trapping detection section which detects whether a foreign matter is trapped between the window frame and the opening and closing member, moving in the open direction, based on the operating state detection signal; and a pinching detection section which detects whether another foreign matter is pinched between the window frame and the opening and closing member, moving in the close direction, based on the operating state detection signal, the control circuit being further configured to restrict supplying an electric power to the driving motor to stop the opening and closing member moving in the open direction when the trapping detection section detects that the foreign matter is trapped, the opening and closing member moving in the open direction having been started based on the open command signal from the manipulation switch, and to then supply the electric power to the driving motor to drive the opening and closing member in the close direction under a restricted state when receiving the close command signal from the manipulation switch after restricting supplying the electric power, the restricted state restricting a predetermined operation.

2. The opening and closing control apparatus according to claim 1, wherein the restricted predetermined operation includes a pinching prevention operation which controls the opening and closing member to be driven reversely by operating the driving motor reversely when the pinching detection section detects the pinching of a foreign matter.

3. The opening and closing member control apparatus according to claim 1, wherein the restricted predetermined operation includes a continuous drive operation of the opening and closing member in the close direction.

4. The opening and closing member control apparatus according to claim 1, wherein the restricted predetermined operation includes a pinching release operation to drive the opening and closing member, which has been driven in the close direction, in the open direction.

5. The opening and closing member control apparatus according to claim 1, wherein the restricted predetermined operation includes a drive operation of the opening and closing member in the close direction for a time exceeding a predetermined operating time.

6. The opening and closing member control apparatus according to claim 1, wherein the restricted predetermined operation includes a drive operation of the opening and closing member in the close direction by a distance exceeding a predetermined movement distance.

7. The opening and closing member control apparatus according to claim 1, wherein the predetermined operation is restricted until a predetermined time elapses or the opening and closing member moves by a predetermined distance.

8. A method for controlling an opening and closing member of an opening and closing member control apparatus, the opening and closing member moving in an open or close direction to at least partially open or close, respectively, an area within a window frame of the opening and closing member control apparatus, the opening and closing member control apparatus including a control circuit that controls the opening and closing member;

a driving motor that is also controlled by the control circuit to drive the opening and closing member in an open direction or a close direction;

a manipulation switch which outputs an open command signal or a close command signal to the control circuit, the open command signal indicating driving of the opening and closing member in the open direction, the close command signal indicating driving of the opening and closing member in the close direction, the opening and closing member being either (i) driven only while the manipulation switch is manipulated or (ii) driven continuously once the manipulation switch is manipulated to a specified position regardless of whether the manipulation switch having been manipulated to the specified position is then released;

an operating state detection section which outputs an operating state detection signal according to an operating state of the opening and closing member that is driven in the open direction or in the close direction by the driving motor;

a trapping detection section which detects whether a foreign matter is trapped between the window frame and the opening and closing member, moving in the open direction, based on the operating state detection signal; and a pinching detection section which detects whether another foreign matter is pinched between the window frame and the opening and closing member, moving in the close direction, based on the operating state detection signal, the method by the control circuit comprising:

restricting supplying an electric power to the driving motor to stop the opening and closing member moving in the open direction when the trapping detection section detects that the foreign matter is trapped, the opening and closing member moving in the open direction having been started based on the open command signal from the manipulation switch; and supplying the electric power to the driving motor to drive the opening and closing member in the close direction under a restricted state when receiving the close command signal from the manipulation switch after restricting supplying the electric power, the restricted state restricting a predetermined operation.

* * * * *